US006320567B1

(12) United States Patent
Hirakata et al.

(10) Patent No.: US 6,320,567 B1
(45) Date of Patent: Nov. 20, 2001

(54) DISPLAY DEVICE

(75) Inventors: Yoshiharu Hirakata; Satoshi Teramoto, both of Kanagawa (JP)

(73) Assignee: Semiconductor Energy Laboratory Co., Ltd, Kanagawa-ken (JP)

( * ) Notice: Subject to any disclaimer, the term of this patent is extended or adjusted under 35 U.S.C. 154(b) by 0 days.

(21) Appl. No.: 09/239,067

(22) Filed: Jan. 25, 1999

Related U.S. Application Data

(63) Continuation of application No. 08/720,679, filed on Oct. 2, 1996, now Pat. No. 5,877,740.

(30) Foreign Application Priority Data

Oct. 19, 1995 (JP) ..... 7-282503

(51) Int. Cl.[7] ..... G09G 3/36
(52) U.S. Cl. ..... 345/100; 345/103
(58) Field of Search ..... 345/87, 103, 100, 345/9, 42, 30, 32; 340/784, 702; 350/333

(56) References Cited

U.S. PATENT DOCUMENTS

| | | | | |
|---|---|---|---|---|
| 4,281,324 | * | 7/1981 | Nonomura et al. | 340/784 |
| 4,824,212 | * | 4/1989 | Taniguchi | 350/333 |
| 4,845,473 | | 4/1988 | Matsuhashi et al. | 340/784 |
| 5,010,413 | | 10/1989 | Bahr | 358/242 |
| 5,012,274 | * | 4/1991 | Dolgoff | 340/702 |
| 5,040,874 | | 8/1991 | Fukuda | 359/54 |
| 5,136,282 | | 8/1992 | Inaba et al. | 345/97 |
| 5,250,931 | | 10/1993 | Misawa et al. | 345/206 |
| 5,376,944 | * | 12/1994 | Mogi et al. | 345/100 |
| 5,387,923 | * | 2/1995 | Mattison et al. | 345/103 |
| 5,565,882 | | 10/1996 | Takanashi et al. | 345/32 |
| 5,642,125 | | 11/1994 | Silverstein et al. | 345/87 |
| 5,655,940 | | 8/1997 | Hodson et al. | 345/42 |
| 5,812,284 | * | 10/1998 | Mizutani et al. | 358/482 |

* cited by examiner

*Primary Examiner*—Steven Saras
*Assistant Examiner*—Fritz Alphonse
(74) *Attorney, Agent, or Firm*—Fish & Richardson P.C.

(57) ABSTRACT

Disclosed is an active-matrix color liquid crystal display (LCD) device capable of reducing loads of peripheral circuits for horizontal scanning control. Six separate active-matrix regions are arranged and integrated on a glass substrate. Two horizontal scan controller circuits are provided such that one acts to a common horizontal scan controller for the left-hand column of three, first to third active-regions, whereas the other is a common controller for the right-hand column of the remaining, fourth to sixth regions. These horizontal scan controllers are designed to operate at different timing schemes from each other causing RGB images formed in the first to third regions and those in the fourth to sixth regions to be superimposed together for projection. With such an arrangement, the horizontal scanning frequency required for one horizontal scan controller can be decreased at half that of a projection image displayable on a viewing screen associated with the LCD device.

14 Claims, 7 Drawing Sheets

| INPUT CONDITION | | OUTPUT CONDITION | |
|---|---|---|---|
| CLKH | CNTϕ | CLKHA | CLKHB |
| 0 | 0 | 0 | 1 |
| 0 | 1 | 1 | 0 |
| 1 | 0 | 0 | 0 |
| 1 | 1 | 0 | 0 |

DISPLAY DEVICE

This is a continuation of U.S. application Ser. No. 08/720,679, filed Oct. 2, 1996, now U.S. Pat. No. 5,877,740.

BACKGROUND OF THE INVENTION

1. Field of the Invention

The present invention relates generally to display devices, and more particularly to large-screen projection display apparatus incorporating a thin display panel for use in producing an image of high resolution for projection onto a viewing screen. The invention also relates to active-matrix color liquid crystal display devices for use in color image projector systems.

2. Description of the Prior Art

Conventionally, display devices using a liquid crystal display (LCD) panel are well known for use in large-screen color image projector systems. The display devices of this type are designed to produce a picture image for display on an associated viewing screen by modulation of light rays using the optical characteristics of liquid crystal materials as sealed in the LCD panel. The presently available LCD display devices come with a display area consisting of an array of rows and columns of picture elements or "pixels" as organized into a planar matrix form; for example, a matrix of 640 by 480 dots having a horizontal array of 640 pixels and vertical array of 480 pixels.

Typically, the LCD display devices are driven in such a manner that information bits are written at respective pixels arrayed in a matrix while sequentially scanning the same causing the liquid crystal at an intended pixel to change in optical response characteristic to finally attain display of a picture image on the screen.

One prior known LCD display scheme on an associated screen is illustrated in FIG. 5, which is of an active-matrix LCD panel with a matrix of m×n pixels, where "m" and "n" are integers. The display operation thereof is as follows. Information is first written into a selected pixel at the upper left address (0, 0) in the uppermost row on the display screen. Then, information is written into its adjacent pixel at a successive address (1, 0). Such writing of information will be sequentially performed with respect to the remaining pixels in the first row while these are being subject to scanning.

After completion of information writing for the first row of pixels, similar write operation is then sequentially carried out with respect to the following, second row of pixels. In this way, the sequential write operation will be repeated up to the final pixel row on the LCD screen of FIG. 5. In the information write procedure formation of one display image is terminated upon completion of information write with respect to the "last" pixel with address (m, n) as located at the lower right corner of the display screen. A resultant one-screen image is called the "frame." Typically, this frame will be rewritten or "refreshed" on the screen for thirty times per second.

To attain the aforesaid simple sequential write operation for LCD display, peripheral driver circuitry (generally integrated on an IC chip) is employed which serves to store data representative of every horizontal line image and to supply such stored one-line scan image data to a corresponding part of active-matrix region with each horizontal line as a unit. This display drive technique is known as the "line sequence" scheme in the art.

As a further advanced arrangement, an LCD display device is known which incorporates an active-matrix region (s) and associative peripheral driver circuits, all of which are integrated on a single substrate that may be made of silicon, glass, or the like. This may enable accomplishment of reduction in thickness and in size, resulting in a decrease in manufacturing cost. However, the prior art is encountered with a serious problem in that the operation frequency is extraordinarily increased forcing the peripheral circuits to operate at higher rate accordingly. In other words, as the operation frequency required for associative horizontal scanning controller circuits becomes equivalent to (m×n×30) Hz, it is required that the controllers operate at extra high speed. By way of example, in the case of a 640×480 dot active-matrix region, it should be required that the horizontal scan controller operate at approximately 10 MHz rate or higher in order to achieve successful horizontal scanning of the active-matrix region.

SUMMARY OF THE INVENTION

It is therefore an object of the present invention to provide a new and improved display device avoiding one or more problems as faced with the prior art.

It is another object of the invention to provide an improved display device capable of reducing the operation frequency without adversely affecting the quality of an image displayed.

It is yet another object of the invention to provide an improved large-screen projection display apparatus incorporating integrated peripheral circuitry capable of reducing the operation frequency without having to degrading displayable images in quality.

It is still another object of the invention to provide an improved active matrix-based LCD panel for use in projecting an image of high resolution on a large screen having a set of peripheral driver circuits integrated on a substrate, capable of decreasing the operation frequency while permitting achievement of enhanced image quality as displayed on the screen.

In accordance with one aspect of the instant invention, a display apparatus includes at least two active matrix regions for formation of an image, first and second horizontal scan controller circuits for providing horizontal scan controls to the active matrix regions respectively, and a vertical scan controller circuit for providing vertical scanning control in common to the active matrix regions. The active matrix regions, the horizontal scan controllers and the common vertical scan controller are all integrated together on the same substrate. Certain images being formed in the active matrix regions are superimposed with each other for production of a resultant image to be projected onto an associated viewing screen, wherein the first and second horizontal scan controllers are specifically arranged such that these operate at a decreased frequency being equivalent in value to half the inherent horizontal scan frequency of an image for projection.

In one illustrative embodiment drawn to the above features, six (two by three) separate active matrix regions for definition of RGB color images therein are disposed on the principal plane of a substrate, which regions are organized into a first group of three active matrix regions and a second group of three regions. In some occasions where monochrome images are to be displayed, or in situations that a color image is to be formed for display in a single active matrix region by use of an associative color filter assembly, a decreased number—two (2)—of active matrix regions are permissible for use therein.

In accordance with another aspect of the invention, the number of active matrix regions being subject to different horizontal scanning control may be increased up to any integer "m" more than 2.

More specifically, a display apparatus includes a substrate, integrated circuitry on the substrate including a prescribed number—i.e., "m"—-of active matrix regions for formation of an image, m horizontal scan controller circuits for performing horizontal scan controls with respect to the active matrix regions respectively, and a vertical scan controller circuit for providing common vertical scan control for the m active matrix regions. Respective images in the m active matrix regions are then superimposed with each other to generate and issue the resulting superimposed image for projection. Importantly, the m horizontal scan controllers operate at a specifically selected frequency that is equivalent to 1/m of the inherent horizontal scan frequency of an image for projection on the display screen.

A common principle for the two aspects of the invention is that a respective one of the horizontal scan controllers is arranged to operate at a specific timing that is different from that of any one of the others. In the both, it may alternatively be arranged that an optical shutter mechanism is employed enabling selection of a respective one of the images while eliminating overlapping of pixel display timing between adjacent ones of the pixels.

A significant feature of the two aspects of the invention is that any horizontally neighboring pixels of an image for projection are formed in different active matrix regions. With such an arrangement, it becomes possible to reduce the operation frequency as required for one horizontal scan controller.

In accordance with still another aspect of the invention, a display device includes an integrated circuitry on a substrate which incorporates at least two active matrix regions for formation of an image, first and second horizontal scan controller circuits for control of horizontal scanning operation for respective ones of the active matrix regions, and a vertical scan controller circuit for providing vertical scan control being common to the active matrix regions. Images as formed in the active matrix regions are then superimposed with each other to provide a superimposed image for projection onto a viewing screen. Very importantly, the device features in that, at a certain row of an image being displayed, the first horizontal scan controller performs writing of information for one of an odd numbered pixel and an even numbered one, whereas the second horizontal scan controller carries out writing of information of the other for the odd- and even-numbered pixels.

In an illustrative embodiment employing the above concept, the first horizontal scan controller attempts to write pieces of information with respect to the even-numbered pixels on the display image (screen image) as demonstrated by $P_0$, $P_2$, $P_4$, . . . in FIG. 3, whereas the second horizontal scan controller writes information pieces for the remaining, odd-numbered ones as shown by $P_1$, $P_3$, $P_5$, . . . in FIG. 3. Combining or superimposing the resulting images on a projection screen results in display of one complete, meaningful row image to be displayed thereon (see FIG. 3C).

In accordance with a further aspect of the invention, a display apparatus is provided which includes a plurality of active matrix regions each being controlled by a corresponding one of associated horizontal scan controller circuits, thereby causing images formed by respective active matrix regions to be superimposed with each other to produce a superimposed image for projection. The display apparatus here features in that any horizontally neighboring pixels of an image for projection are formed by different ones of the active matrix regions.

In an illustrative embodiment following this aspect, two separate horizontal scan controllers 101 and 102 are operatively associated with two active matrix regions (103, 106 in FIG. 1). Further, a projection display apparatus employing an integrated LCD panel shown in FIG. 1 comes with an optical system (408 in FIG. 4) for optically combining images as formed in respective active matrix regions. With the former arrangement, information write operation for horizontally neighboring pixels (those on the projection display screen) is alternately carried out between a first group of three active matrix regions (103 to 105) and a second group of three ones (106–108).

In accordance with a yet further aspect of the invention, a display device includes a plurality of active matrix regions each being controlled by a corresponding one of associated vertical scan controller circuits, thereby causing respective images created by the active matrix regions to be superimposed together for projection, wherein any vertically neighboring pixels of an image for projection are formed by different ones of the active matrix regions.

While the above arrangement is not frequently applicable, this may be preferably employed in cases where the scanning is performed longitudinally rather than laterally.

The above concept assumes the use of an arrangement wherein m (or, m sets of) active matrix regions and m (or m sets of) associated peripheral circuits are formed by integration fabrication techniques on the same substrate. Here, "m" is an integer equal to or more than two (2). Image data of an individual one of pixels constituting one horizontal line (one row) is prepared by the m (or, m sets of) active matrix regions in a divided manner.

For instance, in the case where two separate active regions (103, 106 in FIG. 1) are used to form a one-line image, display is attained while the first active matrix region sequentially scans the images of first alternate pixels—say, odd-numbered ones—whereas display is done with the second active matrix region sequentially scanning the images of the remaining pixels, namely, the even numbered ones.

In other words, for the j-th horizontal line, the first active matrix region is used to write information into selected pixels at addresses (0, j), (2, j), (4, j), (6, j), . . . , (2i, j) in a corresponding horizontal line being actually displayed (j=0, 1, 2, . . . ). The second active matrix region writes information into the remaining alternate pixels at addresses (1, j), (3, j), (5, j), (7, j), . . . , (2i+1, j) in the horizontal line being actually displayed.

The resulting images as created in the two active matrix regions are selected at an appropriate timing causing them to be combined together on a projection display screen. This enables an intended horizontal line image to be sequentially scanned in a normally increment sequence of (0, j), (1, j), (2, j), (3, j), . . . , (i, j) on the actual projection screen, thereby providing a desired display image thereon.

In the above situation the horizontal scan frequency required for respective active matrix regions is decreased at half (½) of that of the case where one active matrix region is used to sequentially scan the pixels (0, j), (1, j), (2, j), (3, j), . . . , (i, j). This is because of the fact that one active matrix region is reduced to be half in information writing load. This results in the horizontal frequency needed for the horizontal scan controllers (101, 102 in FIG. 1) being half that of the display screen as actually obtained.

In the foregoing principle, it becomes possible by use of cooperative m (or, m sets of) active matrix regions individually performing horizontal scan control to reduce the substantive horizontal frequency at 1/m the horizontal frequency required when one (or one set of) active matrix region is used to project an intended image onto the screen.

These and other objects, features and advantages of the invention will be apparent from the following more particular description of preferred embodiments of the invention, as illustrated in the accompanying drawings.

DETAILED DESCRIPTION OF THE INVENTION

Embodiment 1

Figure 1A:
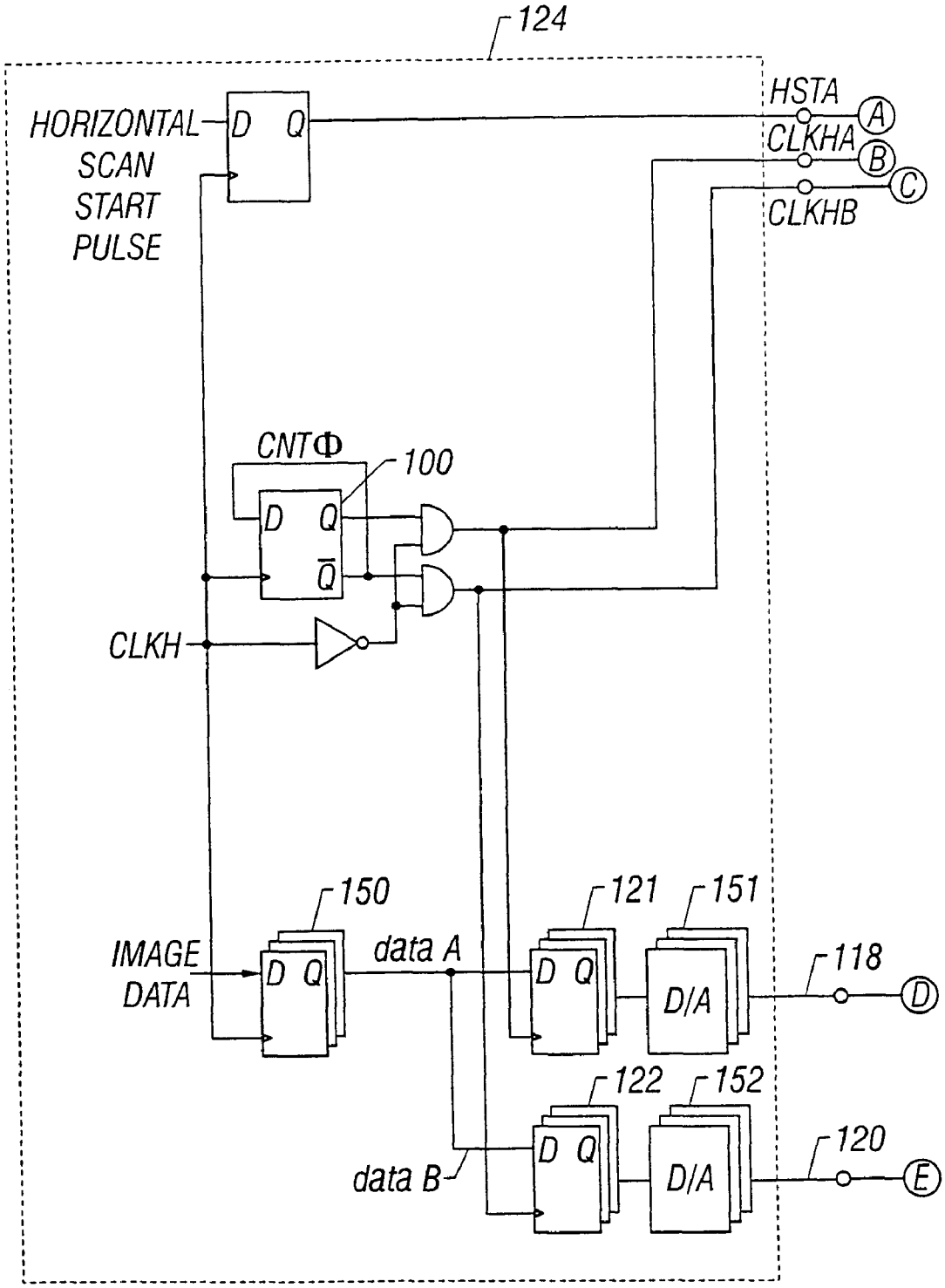
FIG. 1 is a diagram showing an overall configuration of internal electrical circuitry of a liquid crystal display (LCD) panel in accordance with one embodiment of the present invention.
Figure 1B:
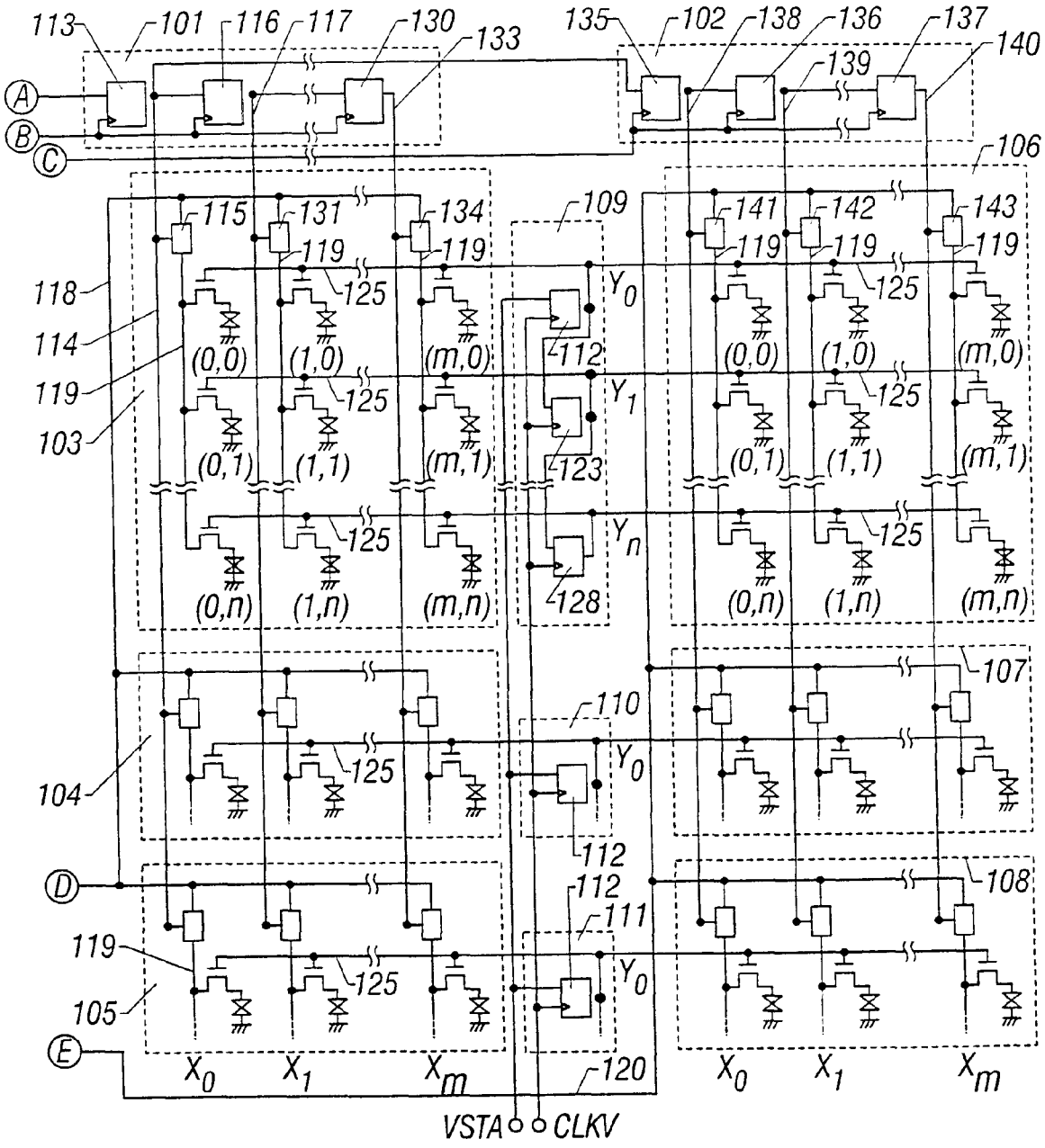

Referring to FIG. 1, a display apparatus in accordance with one preferred embodiment of the invention incorporates a color LCD assembly that includes three pairs of active-matrix regions 103, 104, 105, 106, 107, 108 as integrated together on a light transmissive substrate, which may be made of glass. In other words, the LCD module comes with two sets of integrated active-matrix regions each having a subset of three image formation units, each of which produces one—i.e., red (R), green (G) or blue (B)—of three primary color images. A significant feature of the embodiment is that the two sets of RGB image-forming active-matrix regions 103–108 cooperate to form two arrays of alternate pixels that finally constitute one scanning line of an intended picture image, thereby forcing the horizontal frequency required for one active-matrix region set to drop down at half that of the prior art.

Another feature of the embodiment shown in FIG. 1 is that a plurality of active-matrix regions 103–108 are specifically controlled in operation in such a manner that each set 103–105 (106–108) is controlled by the same horizontal scan controller circuit 101 (102) while each pair of active-matrix regions 103, 106 (104, 107; 105, 108) are by a common vertical scan controller circuit 109 (110, 111). With such an arrangement, and further by use of integration fabrication of a plurality of active-matrix circuits and horizontal/vertical scan controllers on the same substrate, the resulting display device can be simplified in overall structure reducing size and production cost thereof as a whole.

In the display device of FIG. 1, one desired color image is formed by combination of an R image component optically modulated in active-matrix region 103, a G image component in active-matrix region 104, and a B image in active-matrix region 105.

Likewise, another color image is obtained by combination of an R' image component optically modulated in active-matrix region 106, a G' image component in active-matrix region 107, and a B' image in active-matrix region 108.

Also in the illustrative embodiment of FIG. 1, the horizontal scan controller circuit 101 operates to simultaneously perform horizontal scan operations for the active-matrix region 103 optically modulating the R image, active-matrix region 104 modulating G image, and active-matrix region 105 modulating B image.

Similarly, the horizontal scan controller circuit 102 operates to simultaneously perform horizontal scan operations for the active-matrix region 106 modulating the R' image, active-matrix region 107 modulating G' image, and active-matrix region 108 modulating B' image.

The vertical scan controller circuit 109 simultaneously performs vertical scan control operations for active-matrix region 103 optically modulating R image and for active-matrix region 106 modulating R' image.

Another vertical scan controller circuit 110 simultaneously carries out vertical scan control operations for active-matrix region 104 optically modulating G image and active-matrix region 107 modulating G' image.

The remaining vertical scan controller circuit 111 simultaneously carries out vertical scan control operations for active-matrix region 105 optically modulating B image and active-matrix region 108 modulating B' image.

Very importantly, the display device of FIG. 1 is arranged such that the vertical scan control of R'G'B' active-matrix region set 103–105 and that of RIBIGI active-matrix region set 109–111 are executed at different timings as deviated or time-shifted from each other. More specifically, the horizontal scan controllers 101, 102 operate at a shifted timing that differs from each other, while allowing the vertical scan controllers 109–111 to operate at exactly the same timing.

In the arrangement of FIG. 1, the horizontal scan controllers 101, 102 are controlled in operation in response to certain clock signals CLKHA, CLKHB as generated and issued from a clock generator circuit 100, which includes a flip-flop circuit, two AND gates and an inverter. The clock signal CLKHA is for control of horizontal scan operations as executed by the RGB active-matrix region set 103–105, whereas clock CLKHB is for R'G'B' active-matrix region set 106–108.

Figure 2:
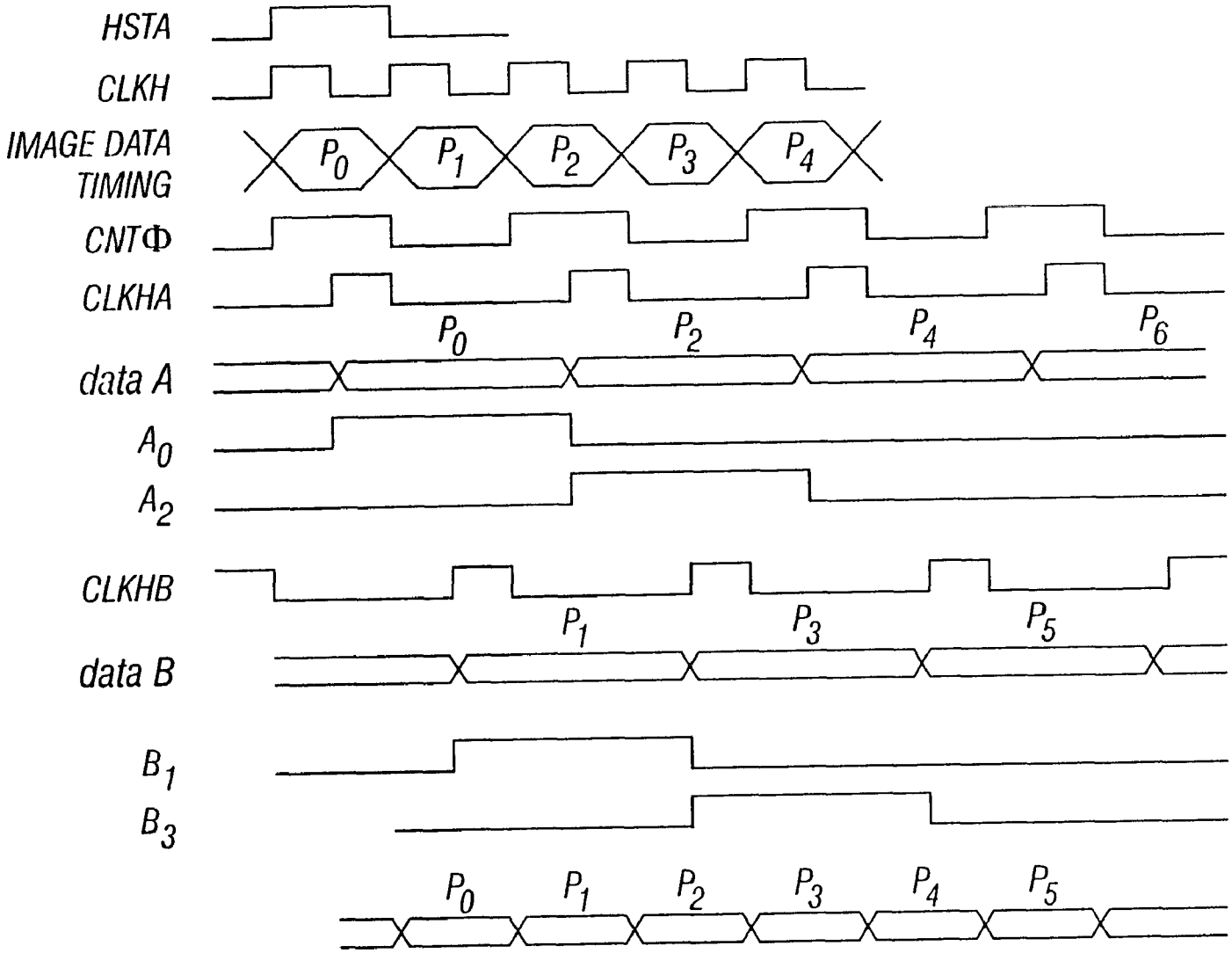
FIG. 2 is a timing diagram for illustration of timing sequences of major pulse signals during operation of the LCD panel shown in FIG. 1.
Figures 5, 6:
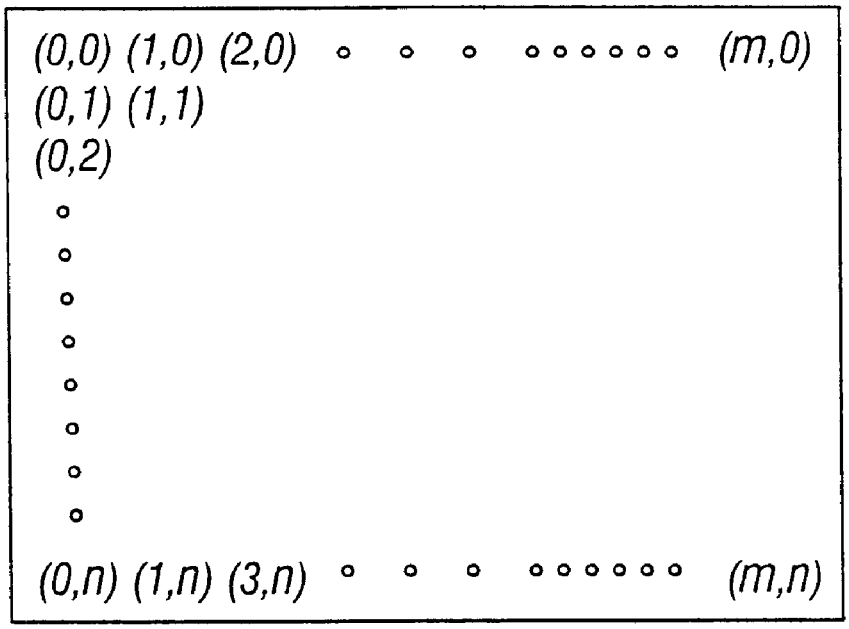
FIG. 5 is a diagrammatic representation for explanation of a display method in one prior art LCD device.
FIG. 6 is a diagram showing a correlation between signals for use in displaying images as employed in the embodiment of FIG. 5.

See FIG. 6, which shows the input/output logic value correlation of input signals CLKH, CNTΦ versus output signals CLKHA, CLKHB. The clock signals CLKHA, CLKHB are produced by clock generator 100 which attempts to determine or identify the logic level of signals CLKH, CNTΦ as shown in FIG. 2, these clock signals are phase-shifted from reference clock signal CLKH by ½ frequency of CLKH or by one phase thereof. More specifically, each clock signal CLKHA, CLKHB has a train of "alternate" pulse components which are produced from reference clock signal CLKH in such a manner that clock CLKHA is shifted in phase by the half period of clock CLKH, and that the pulses of CLKHA, CLKHB are phase-shifted from each other by one period of clock CLKH causing each pulse of clock CLKHA to fall at a midway position between adjacent pulses of CLKHB, and vice versa, as shown in FIG. 2.

Regarding the vertical scan control, the same operation is carried out with respect to all the active-matrix regions 103-108. More precisely, upon receipt of a vertical scan control clock signal CLKV, a vertical scan timing enable signal VSTA is issued allowing scanning to sequentially progress from the row of (m, 0) (first row) to the row of (m, n) (n-th row) in one active-matrix region 103, by way of example. The signals CLKV, VSTA are input at exactly the same timing with respect to all the active-matrix regions 103-108, whereby the vertical scanning operation will continue simultaneously in all active-matrix regions 103–108.

In a main control/signal processor circuit 124 of FIG. 1, image data as provided by a circuit 150 has a specific timing identical to that of the horizontal scan clock CLKH as shown in FIG. 2. By contrast, the output "delivery" timing of such image data being developed onto image data lines 118, 120 is specifically determined by flip-flop circuits 121, 122 in response to clocks CLKHA, CLKHB as generated from the circuit 100.

Accordingly, as shown in FIG. 2, the image data items are developed onto the image data line 118 substantially at a timing as labeled "data A" which defines the sequence of $P_0$, $P_2$, $P_4$, . . . , whereas the image data items are sent to the image data line 120 at a different timing as labeled "data B" in FIG. 2 which defines the sequence of $P_1$, $P_3$, $P_5$, . . . Additionally, the image data items as output from the flip-flop circuits 121, 122 are fed to digital-to-analog (D/A) converter circuits 151, 152 for conversion into corresponding analog video signals, which are then supplied onto image data lines 118, 120.

The operation of the display device shown in FIG. 1 will now be described in more detail as follows. First of all, the flip-flop circuit 112 of the vertical scan controller 109 operates to generate and issue the vertical scan timing enable signal VSTA in response to occurrence of the rising edge of a pulse of vertical scan control clock signal CLKV (not shown). This causes the input node of "n=1"th ($Y_0$-th row) flip-flop circuit 112 to be at logical High ("H") level in a respective one of the vertical scan controllers 109–111.

The flip-flop circuit is a bistable multivibrator offering two different stable states in operation. Assume that the output of such flip-flop circuit is at logical Low ("L") level whereas the input thereof is at logical High ("H") level. When a clock signal is fed thereto applying the rising edge of an incoming pulse to the input of such flip-flop, the output thereof potentially changes at the "H" level. Thereafter, the rising edge of a successive pulse is input to the flip-flop, the output changes in potential to return at the "L" level. While not illustrated, each flip-flop is arranged to receive a reset signal as provided by a sequencer or power-on circuit, which signal may either be synchronized or be asynchronous with the clock CLKH.

Insofar as the rising edge of a next clock pulse is not supplied to the flip-flop circuit, the flip-flop output remains at "H" level. Additionally, while the input is at "L" level, the output continues holding "L" level even upon input of any clock edges.

For example, consider that the "n=1"th ($Y_0$-th) flip-flop circuit 112 in the vertical scan controller 109 for active-matrix regions 103, 106 receives at its input the vertical scan timing enable signal VSTA that is presently at "H" level. Under this condition, the vertical scan control clock signal CLKV is input to flip flop 112, causing it to change in output potential from "L" to "H" level. As a result, the $Y_0$-th gate signal line 125 coupled thereto potentially changes up to "H" level. This in turn forces all the thin-film transistors (TFTs) to turn on in the $Y_0$-th row of the active-matrix regions 103, 106. In other words, all the TFTs are rendered conductive which are designated by the addresses (0, 0), (0, 1), . . . , (m, 0) in these active-matrix regions 103, 106.

While the foregoing explanation assumes that the first pair of active-matrix regions 103, 106 are two exemplary regions of interest, the same is true for the remaining pairs 104, 107; 105, 108. For instance, regarding the second (third) pair of active-matrix regions 104, 107 (105, 108), a flip-flop circuit 112 included in the vertical scan controller 110 (111) associated with regions 104, 107 (105, 108) may operate in substantially the same way as in that of vertical scan controller 109 letting all the gate lines 125 in the $Y_0$-th row of regions 104, 107 (105, 108) be at "H" level at a time.

It should be noted that in the vertical scan controller 109, the flip-flop 112 is operatively associated with flip-flop circuits including $Y_1$-th flip-flop 123 and $Y_n$-th row flip-flop 128. The remaining vertical scan controllers 110, 111 are similar in configuration to controller 109 although their detailed illustration is omitted for purposes of illustration only.

Under the above condition, clocks CLKHA, CLKHB are supplied to the horizontal scan controllers 101, 102 at the timings as shown in FIG. 2.

In the illustrative embodiment, the clocks CLKHA, CLKHB are specifically arranged so that these serve to apply the effective edge alternately to the horizontal scan controllers 101, 102.

Accordingly, first, in the flip-flop 113 of the $X_0$-th row in the horizontal scan controller 101, a horizontal scan timing enable clock signal HSTA is issued in response to receipt of the rising edge of clock CLKHA causing an output signal being developed onto an image sampling signal line 114 to potentially change at "H" level. The image sampling signal output to line 114 is shown by $A_0$ in the timing diagram of FIG. 2.

The level change to "H" level on the image sampling signal line 114 allows the $X_0$-th row sample-and-hold (S/H) circuit 115 to fetch image data presently available on image data line 118 (its timing is designated by "data A" in FIG. 2).

In this situation the image data being output to image data line 118 is also controlled in a way synchronized with clock CLKHA. On the other hand, image data being fed to the active-matrix regions 106–108 may be controlled in synchronism with clock CLKHB.

As a result of fetching the image data labeled "data A" in FIG. 2 from image data line 118 to S/H circuit 115, image data may flow into the $X_0$-th row image signal line 119, which is connected to the source of a TFT in the $X_0$-th column. This may accomplish a status that a certain data signal is applied to the sources of TFTs at the addresses of (0, 0), (0, 1), . . . (0, n) in the active-matrix region 103.

Under such condition a signal voltage is applied to the gate electrodes of selected TFTs at the addresses (0, 0), (1, 0) . . . , (m, 0) rendering them conductive (turn-on state). Consequently, here, one TFT with the (0, 0) address becomes operative allowing certain information to be written onto a corresponding pixel electrode at address (0, 0).

A time duration for the information write operation is a period that corresponds in length to the "H" hold time period of signal $A_0$ shown in FIG. 2, which time period in turn equals to the period as required for S/H circuit 115 to fetch the image data denoted by "data A" therein. Accordingly, image data $P_0$ is fetched and held in S/H circuit 115 of the $X_0$-th row.

In this embodiment, the timing of image data during horizontal scanning periods is also determined by flip-flop circuits 121, 122. Accordingly, it may be considered that as shown in FIG. 2, writing of information into active-matrix region 103 is performed at the timing substantially the same as that of data A as designated by $P_0$, $P_2$, $P_4$, . . .

Writing of information into the pixel at address (0, 0) is completed upon input of the rising edge of a successive clock pulse CLKHA to flip-flop circuit 113. More specifically, when the rising edge of a next incoming pulse of clock signal CLKHA enters flip-flop circuit 113, the output signal $A_0$ thereof drops down at "L" level, causing the image sampling signal line 114 to be at "L" level. This serves to disenable fetching of image data at S/H circuit 115 preventing a certain signal voltage from being applied to the source of a TFT at the address (0, 0). As a result, writing of information into address (0, 0) is inhibited.

When the output of $X_0$-th row flip-flop circuit 113 is potentially changed at "L" level, an output signal $A_2$ of the $X_1$-th row flip-flop circuit 116 is forced to change at "H" level simultaneously. As a result, an associated image sampling signal line 117 changes in potential up to "H" level.

This means that until before a successive pulse of clock signal CLKHA comes, the image sampling signal line 114 is kept at "H" level whereas the image sampling signal line 117 remains at "L" level. When the rising edge of the next clock pulse CLKHA enters flip-flop circuit 116, image sampling signal line 114 potentially drops down at "L" level while image sampling signal line 117 rises up to "H" level.

While the output signal $A_2$ stays at "H" level, certain image data $P_1$ of the image data labelled "data A" in FIG. 2 is fetched from the image data line 118 to S/H 131, causing image data $P_1$ to be written onto the pixel electrode at the address (1, 0) through the image signal line 119. Similar write operation is sequentially repeated with respect to the remaining addresses (2, 0), (3, 0), (4, 0), . . . , (m, 0).

The information write is sequentially carried out in such a way as follows: as shown in FIG. 2, while the output $A_0$ of the flip-flop circuit 113 of FIG. 1 is at "H" level, image data $P_0$ (see "data A" in FIG. 2) is written into the address (0, 0); while the output $A_2$ of flip-flop circuit 116 is at "H" level, image data $P_2$ is written into the address (0, 1); and, while the output $A_{2m}$ of the $X_m$-th row flip-flop circuit 132 is at "H" level, image data $P_{2m}$ is written into the address (0, m). Note here that the numerals 133, 134 designate $X_m$-th row image sampling signal line and its associated S/H circuit, respectively.

On the other hand, the signal $A_0$ which is supplied to the image sampling signal line 114 is fed as a horizontal scan timing enable signal to the $X_0$-th column flip-flop circuit 135 of the horizontal scan controller 102. In the flip-flop circuit 135, when this signal is issued in response to receipt of clock pulse CLKHB being supplied thereto at a specific timing shown in FIG. 2, a horizontal scan signal $B_1$ appearing at the output of flip-flop circuit 135 is changed to "H" level causing image sampling signal line 138 at "H" level.

The above operation may also be considered that in the $X_0$-th column flip-flop circuit 135 of horizontal scan controller 102, the signal $A_0$ is issued in responding to clock pulse CLKHB thus generating signal $B_1$.

While the output signal $B_1$ is at "HI" level, the $X_0$-th column S/H circuit 141 attempts to fetch image data labelled "data B" in FIG. 2 from image data line 120. Accordingly, image data $P_1$ is fetched into S/H 141 causing image data P, to be written into the address (0, 0) by way of image signal line 119.

Where the signal $A_0$ is again issued by clock CLKHB at the $X_0$-th column flip-flop circuit 135, the output signal $B_1$ of flip-flop 135 drops down at "L" level thus completing the data write to the address (0, 0).

At the exact time point when the output signal $B_1$ is at "L" level, an output signal $B_3$ of the $X_1$-th column flip-flop circuit 136 potentially rises up to "H" level simultaneously, forcing an image sampling signal line 139 at "H" level, whereby image data $P_3$ of the image data labelled "data B" in FIG. 2 is fetched to a flip-flop circuit 142 and then written into a pixel at the address (1, 0).

In this way, the start and termination of data write into addresses will be repeated in synchronization with the clock pulse signal CLKHB allowing information to be sequentially written into the active-matrix region 106 at the addresses (2, 0), (3, 0), (4, 0), . . . , (m, 0). Note that the numerals 137, 140, 143 denote the $X_m$-th column flip-flop circuit, image sampling signal line, and S/H circuit, respectively.

It can be readily seen by viewing the timing diagram of FIG. 2 that the horizontal scan control clock signals CLKHA, CLKHB are shifted in phase with each other by $f_{CLKH}/2$ (where "$f_{CLKH}$" is the frequency of clock CLKH), or by one period or cycle of reference clock CLKH. Therefore, the resulting horizontal scan signals $A_0$, $B_0$ are also phase-shifted with each other by $2/f_{CLKH}$ or the period of clock CLKH.

This may be reworded as follows: during a time period wherein information is written into the address (0, 0) of the active-matrix region 103, information begins to be written into a specific pixel at the address (0, 0) in the active-matrix region 106. And, during such write operation for address (0, 0) in the active-matrix region 106, writing of information gets started with respect to another pixel at the address (1, 0) in active-matrix region 103.

In this way, the two neighboring active-matrix regions 103, 106 are subject to "alternate/sequential" write operation in such a manner that the columns of pixels thereof are alternately selected for write between active-matrix regions 103, 106 while allowing a presently selected column of pixels of either region 103, 106 to be sequentially selected for write at a specific timing that permits partial overlapping of sequential write operation for one region 103 and that for the other 106. Namely, writing of information is alternately effected between active-matrix regions 103, 106 in the sequence shown by $P_0$, $P_1$, $P_2$, $P_3$, $P_4$, . . . in FIG. 2.

After completion of information write to the $Y_0$-th row, the output of flip-flop circuit 112 drops down at "L" level in response to receipt of the rising edge of a successive pulse of vertical scan control clock signal CLKV causing the $Y_0$-th row gate signal line 125 to potentially change at "L" level. Accordingly, all the TFTs in the $Y_0$-th row are rendered nonconductive (turned off) at a time. This acts to turn off all TFTs at the pixels with the addresses (0, 0), (1, 0), . . . , (m, 0) in the active-matrix regions 103, 106.

At this time, the output of $Y_1$-th row flip-flop circuit 123 changes to "HH" level in the vertical scan controller 109 causing all TFTs in the $Y_1$-th row to turn on. This serves to turn on all TFTs at the pixels with the addresses (0, 1), (1, 1), . . . , (m, 1) in the active-matrix regions 103, 106.

Subsequently, the write operation for the $Y_0$-th row is similarly performed with respect to the $Y_1$-th row of the active-matrix regions 103, 106 under the control of the horizontal scan controllers 101, 102, thereby allowing information being stored in a corresponding S/H circuit to be a sequentially written into the pixels thereof. The same goes with another pair of active-matrix regions 104, 107, and also with yet another pair of active-matrix regions 105, 108.

It should be noted in FIG. 1 that all the active-matrix regions 103–108 are the same or substantially the same in internal circuit configuration as one another although detailed configuration of active-matrix regions 104, 105, 107 and 108 are partly omitted for purposes of illustration only.

Resultant images formed in one set of three active-matrix regions 103, 104, 105 are optically combined or superimposed with one another by use of an appropriate optical system, and are then projected onto a spaced-apart viewing screen providing a meaningful color picture image thereon.

Such color image may also be attained by superimposing images formed in the other set of three active-matrix regions 106–108 with one another using appropriate optical system and then projecting a superimposed image onto the screen.

Figure 3A:
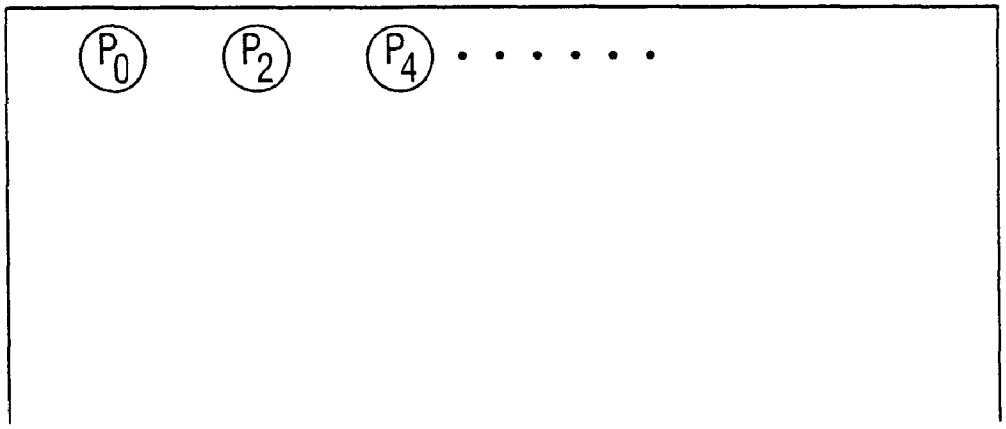
FIGS. 3A to 3C are diagrammatic representations of some image patterns being displayed on the LCD panel of FIG. 1.
Figure 3B:
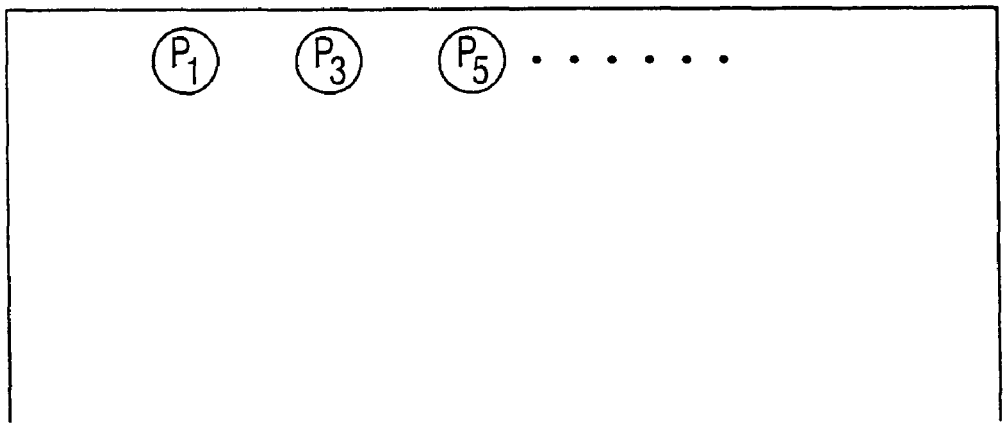
Figure 3C:
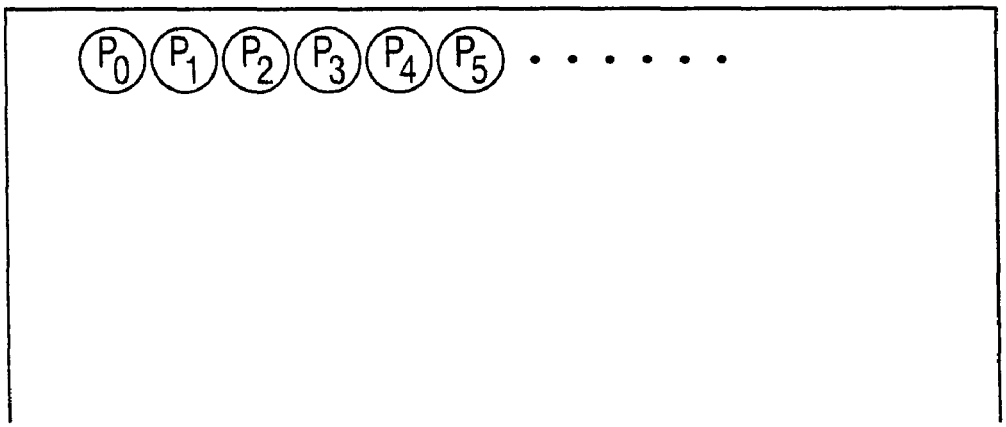

One exemplary image superimpose scheme is diagrammatically represented in FIGS. 3A to 3C. FIG. 3A shows horizontal scanning conditions of images as formed in the first set of active-matrix regions 103–105 under the assumption that these images are combined for projection onto an associated screen. FIG. 3B depicts horizontal scanning conditions of images as formed in the second set of active-matrix regions 106–108 which images are also combined for projection. Note here that the two projected images are arranged to have an adequate distance between adjacent ones of the pixels in the horizontal direction.

Consider that the two color images of FIGS. 3A and 3B are optically combined or superimposed with each other. Now imagine that the six active-matrix regions 103–108 of FIG. 1 are superimposed together by use of an appropriate optical system for projection onto a display screen.

The resulting image superimposed for projection is shown in FIG. 3C. This display is performed under the condition that the timing for the train of data items labelled "data A" in FIG. 2 and that for data train labelled "data B" are overlapped. This attains sequential horizontal scanning operations in such a manner as follows: the pixel $P_0$ is displayed first; during the display of it, the next pixel $P_1$ is displayed; during display of the pixel $P_1$, a successive pixel $P_2$ is displayed, and so forth.

Figure 4:
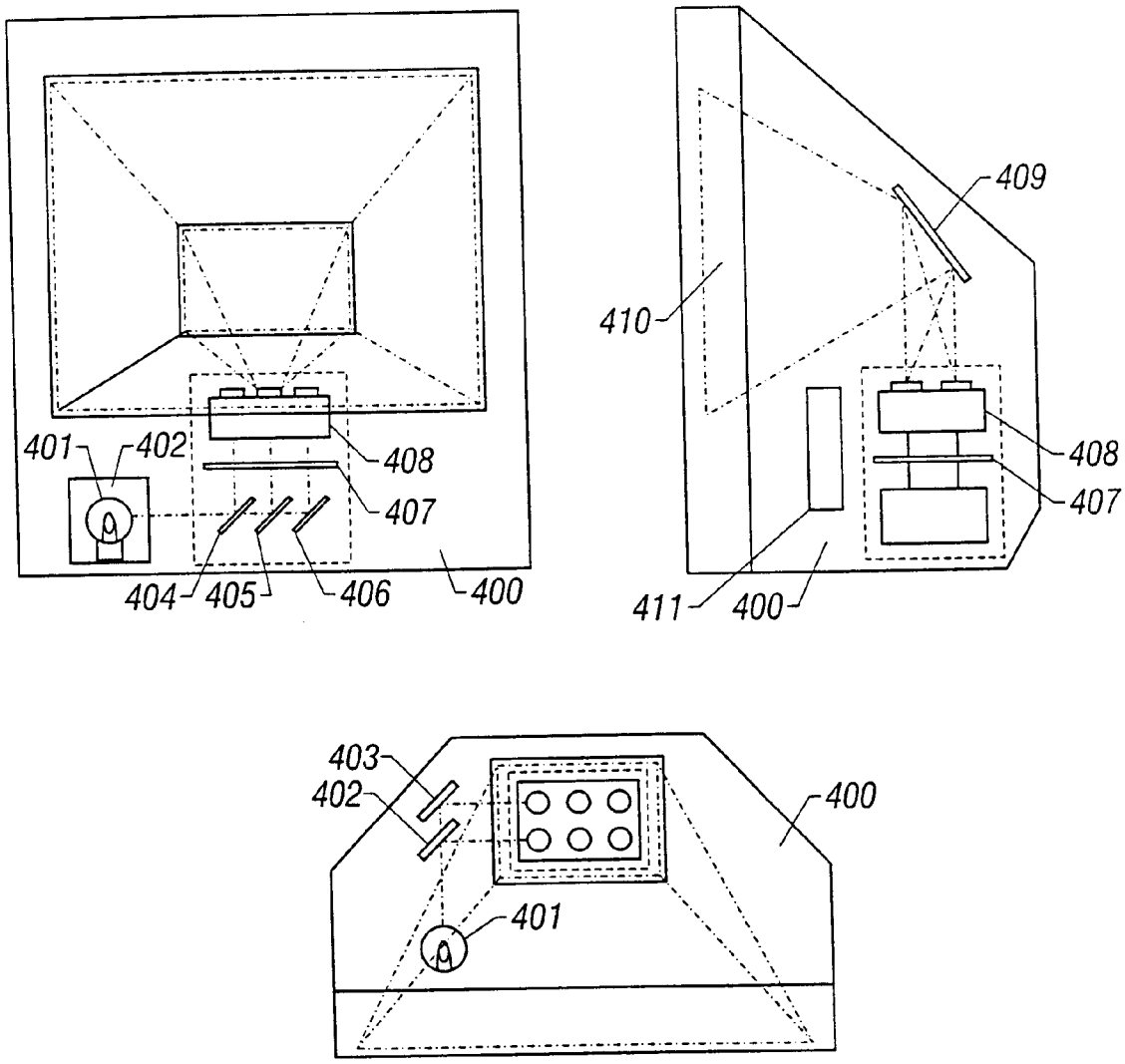
FIG. 4 is a diagram schematically illustrating a display apparatus of screen-projection type in accordance with another embodiment of the invention.

A large-screen projection color LCD display apparatus is shown in FIG. 4, which is constituted from an enclosure or housing 400, a light source 401 built in housing 400, and a half-mirror 402 for reflection of an incident light from light source 401 to send forth an output light for use in providing three light component with the primary colors—namely, red (R), green (G) and blue (B). The projection display apparatus also includes another half-mirror 403 which receives the light from light source 401 to output light for use in providing other three image light rays R', G' and B'.

The output light of the half-mirror 402 is optically guided to enter a series combination of three dichroic mirrors 404, 405, 406 in this order. The first dichroic mirror 404 reflects a selected color—here, blue (B)—of light while allowing others to pass through it. The second dichroic mirror 405 receives the output light of the previous mirror 404 to reflect another selected color—e.g., green (G)—of light while permitting penetration of others. The third dichroic mirror 406 acts to reflect the remaining one of the three primary colors—i.e., red (R) in this case.

In addition to the dichroic mirrors 404–406, another set of dichroic mirrors are disposed adjacent the mirrors 404–406, for similar optical extraction of RGB colors of lights from the light reflected off from the half-mirror 403.

As shown in FIG. 4, the projection LCD display apparatus comes with an integrated LCD panel 407. This LCD panel 407 is electrically connected to a main control circuit 411 which controls operation thereof. Control circuit 411 incorporates a controller for control over major signals, including the clock pulse signals CLKHA, CLKHB, horizontal scan timing enable clock signal HSTA and others, which controller may be the function block 124 shown in FIG. 1. The operation of LCD panel 407 has been set forth previously.

Images that has been optically modulated at the LCD panel 407 result in two sets of images: one set of RGB images being optically modulated by use of active-matrix regions 103–105, and the other set of R'G'B' images as optically modulated by active-matrix regions 106–108.

Respective ones of the optically modulated images at the LCD panel 407 are projected by an optical system 408. These images are reflected off at a mirror 409 to be projected and focussed onto the plane of a viewing screen of the apparatus.

In this way, on the projection screen 410, alternate ones of pixel columns are sequentially filled or displayed in an image having a matrix of pixels thereof. In other words, it may be attained in one row that as shown in FIG. 3C, image components of pixels $P_0$, $P_1$, $P_2$, $P_3$, . . . are sequentially displayed on screen 410.

During the operation, the horizontal scan controller 101 can be lightened in workload so that it is allowed to write information into a decreased number of pixels selected from among those being actually displayed—i.e., mere half the all pixels contained in one row. This may also allow it to operate at a rate that is half the rate of actual display operation. This is resulted from the fact that the two horizontal scan controllers 101, 102 are allowed to operate alternately in response to receipt of clock signals CLKHA, CLKHB of FIG. 2.

In the illustrative embodiment two horizontal scan controllers are employed to display one image on the screen. However, the present invention should not be exclusively limited thereto; alternatively, the invention may also be applicable to a case where three sets of images RGB, R'G'B', R"G"B" under superimposition are prepared and are controlled by horizontal scan controllers respectively each of which may be responsive to the clock signals CLKHA, CLKHB and CLKHC. In such case, the operation rate of one horizontal scan controller is one-third (⅓) the horizontal scan speed of a resulting image being presently displayed on the screen.

It has been described that an RGB image is formed using separate active-matrix regions. This may alternatively be modified in arrangement so that a single active-matrix region incorporating a color filter is used to produce a color image. In this case, the vertical scan controllers 109–111 shown in FIG. 1 are replaced with only one controller.

The foregoing embodiment has been described under the assumption that this is drawn to a specific arrangement employing the point-sequence scan technique. This will alternatively be modified so as to employ one of the line sequence scan techniques. In addition, the foregoing arrangement employs the horizontal and vertical scan controllers that are structured using shift registers. These may be modified to make use of counter decoders rather than such shift registers.

Embodiment 2

A description will now be given of an LCD display apparatus in accordance with a further embodiment of the present invention in connection with FIG. 7, which shows a model of an optical system preferably for use in the case where extra high-speed horizontal scan control is strictly required. This embodiment shown employs a lenticular screen 701 with a crossed cylindrical lens array—these sometimes are called the "fly's-eye lenses"—to display a three dimensional (3D) image or a plurality of images at a time.

Lenticular lenses offer a specific function of enabling the user to view different positions on the screen at different angles to observe. The use of such lenticular lenses may enable the user to see different images between his or her right and left eyes; it may also enable two or more persons to see a plurality of different images at a time.

However, the use of such lenticular lenses does not come without accompanying a problem in that the horizontal (row) image resolution is decreased with an increase in number of images being displayed simultaneously. While this may be avoided by simply increasing the pixel number in the horizontal direction causing the pixels to increase in number. This however strictly requires that the horizontal scan frequency be increased accordingly.

This embodiment is specifically arranged to increase the horizontal scan frequency on the display screen by employing the previously discussed concept of the present invention.

Figure 7:
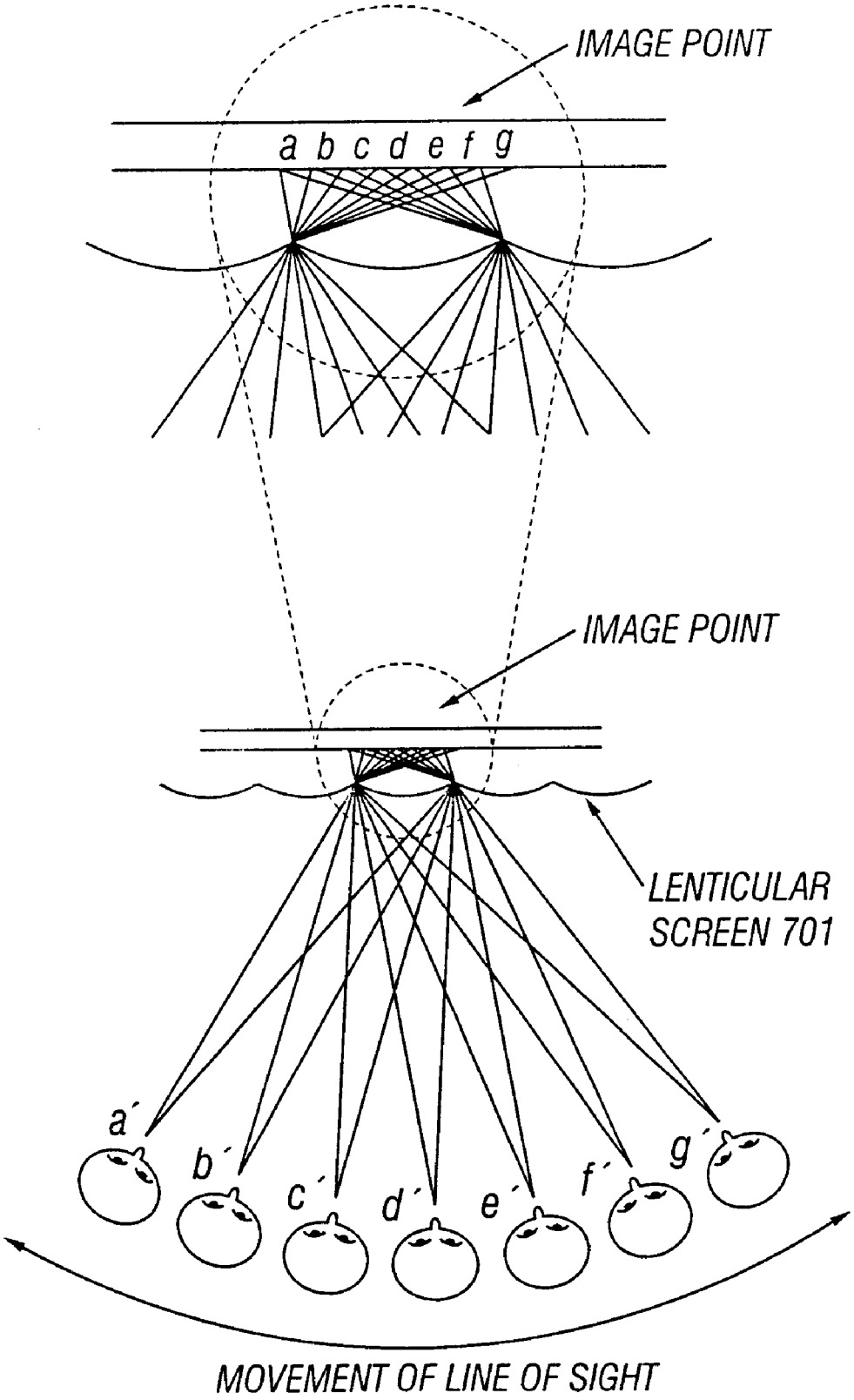
FIG. 7 illustrates a model for image display evaluation of an image display system using a lenticular lens therein.

More specifically, the integrated LCD panel shown in FIG. 1 is used to form an image corresponding to the data train labelled "data A" in FIG. 2 at image points a to c of the lenticular screen 701 of FIG. 7 while forming an image corresponding to the data train labelled "data B" at image points e to g. Note that the image point d is an area that forces a monochrome background—i.e., white or black—or an appropriate background color to be displayed suppressing or eliminating occurrence of undesired crosstalk between the "data A" image and "data B" image.

The display scheme may be employed in some specific applications: one example is an arrangement that enables the user to see a 3D picture image by simultaneously looking at the two images on his right and left eyes separately; another example is an arrangement enabling a plurality of users to individually see one of the "data A" image and "data B" image at different viewing angles.

In the case where the display scheme of FIG. 7 is employed, the horizontal scanning is sequentially carried out in the order of "a" to "g." To ensure that the two images are displayed without having to decrease the horizontal resolution, it is required that the horizontal scan frequency be increased.

To achieve this, the "horizontally m-divided active-matrix region" feature of the present invention as discussed previously is utilized enabling the horizontal scan frequency required for one horizontal scan controller to be 1/m that of the case using a single active-matrix region for display shown in FIG. 7. As a consequence, even when the display scheme of FIG. 7 is employed, it becomes possible to attain displaying of high-resolution picture image(s).

Embodiment 3

A further embodiment of the present invention will be described, which is arranged to follow the foregoing concept of the invention in case where a plurality of images are displayed by use of time-division displaying techniques, or in case where a 3D image is achieved on the display screen. In the case of performing the time-division display, a correspondingly increased amount of information should be required; obviously, it is required that the horizontal scan frequency increase accordingly.

Even in such case, the horizontal scan frequency required for one horizontal scan controller can be reduced at 1/m that on an image being actually displayed on the screen, by arranging the integrated LCD panel shown in FIG. 1 such that it employs m×3 (where "m" is an integer equal to or more than 3) active-matrix regions being integrated thereon while causing m horizontal scan controls to be sequentially carried out with each control being shifted in timing from others. It is thus possible to increase the resolution of a time-division image display screen.

A significant advantage of the present invention is that in large-screen active-matrix display device incorporating peripheral circuits integrated on a substrate, the operation frequency required for the peripheral circuits can be successfully reduced without having to degrade in quality picture images displayable by the screen.

Another advantage of the invention is that controlling respective horizontal scan controllers by use of a single clock signal enables the circuit configuration to be simplified while permitting enhancement in reliability. Practically, the horizontal scan controllers can be made simpler in wiring pattern. Further, it will no longer take place that a plurality of clock signals interfere with one another in the horizontal scan controllers; consequently, it becomes possible to suppress or eliminate occurrence of any erroneous operation or malfunction, increasing reliability.

A further advantage is that superimposing of a plurality of images serves to enable the resulting display image to increase both in brightness and in precision.

It has been described that the present invention is capable of increasing the horizontal scan frequency on an image being presently displayed on the screen; this concept is applicable not only to ordinary 2D images but also to 3D images. For instance, an increase in horizontal scan frequency as required for use with the lenticular lens screen or time-division display techniques can be successfully accomplished without increasing the load of horizontal scan controllers associated therewith.

While the invention has been particularly shown and described with reference to preferred embodiments thereof, it will be understood by those skilled in the art that the foregoing and other changes in form and details may be made therein without departing from the spirit and scope of the invention.

What is claimed:

1. An electric device comprising:

m active matrix regions; and m horizontal scanning circuits, each of said m horizontal scanning circuits connected to corresponding image signal line, wherein each of said m horizontal scanning circuits selects corresponding one of said m active matrix regions every m times, wherein said m horizontal scanning circuits are controlled by m sets of control signals, respectively, and wherein said m horizontal scanning circuits operate at a frequency equivalent to 1/m of a horizontal scan frequency of a displayed image.

2. The device of claim 1 wherein each of the m sets comprises a horizontal scan control clock signal and a horizontal scan timing enable signal.

3. The device of claim 1 further comprising a vertical scanning circuit supplying a common vertical scanning signal to gates of transistors provided in pixels on each row.

4. The device of claim 1 wherein pixels of said device are scanned by a point-sequence scan technique.

5. An electric device comprising:

two active matrix regions; and two horizontal scanning circuits, each of said two horizontal scanning circuits connected to corresponding image signal line, wherein said two horizontal scanning circuits alternatively select said two active matrix regions, respectively, wherein said two horizontal scanning circuits are controlled by two sets of control signals, respectively, and wherein said two horizontal scanning circuits operate at a frequency equivalent to ½ of a horizontal scan frequency of a displayed image.

6. The device of claim 5 wherein each of the two sets comprises a horizontal scan control clock signal and a horizontal scan timing enable signal.

7. The device of claim 5 further comprising a vertical scanning circuit supplying a common vertical scanning signal to gates of transistors provided in pixels on each row.

8. The device of claim 5 wherein pixels of said device are scanned by a point-sequence scan technique.

9. An electric device comprising:

m active matrix regions;

a counter circuit operated in n bits for generating a clock signal and an enable signal for sequentially accessing said m active matrix regions where n is a natural number equal to or greater than 1, each of said n bits being represented by Q and Q;

a decoder circuit comprising a plurality of combinational circuits; and a circuit for generating signals of m divided images inputted pixels through image signal lines synchronously with said clock signal at a frequency 1/m of that of a displayed image.

10. The device of claim 9 wherein timings of the generation of said signals of said m divided images do not coincide with each other.

11. The device of claim 9 wherein said signals of said m divided images synchronizes with clock signals having a frequency 1/m of that of said displayed image.

12. An electric device comprising:

two active matrix regions;

a counter circuit operated in n bits for generating a clock signal and an enable signal for sequentially accessing said two active matrix regions where n is a natural number equal to or greater than 1, each of said n bits being represented by Q and Q;

a decoder circuit comprising a plurality of combinational circuits; and a circuit for generating signals of two divided images inputted pixels through image signal lines synchronously with said clock signal at a frequency ½ of that of a displayed image.

13. The device of claim 12 wherein timings of the generation of said signals of said two divided images do not coincide with each other.

14. The device of claim 12 wherein said signals of said two divided images synchronizes with clock signals having a frequency ½ of that of said displayed image.

* * * * *